US009599302B2

(12) United States Patent
Fedosik et al.

(10) Patent No.: US 9,599,302 B2
(45) Date of Patent: Mar. 21, 2017

(54) HEADLIGHT LENS FOR A VEHICLE HEADLIGHT

(75) Inventors: Dmitry Fedosik, Lippstadt (DE); Wolfram Wintzer, Jena (DE)

(73) Assignee: Docter Optics SE, Neustadt an der Orla (DE)

( * ) Notice: Subject to any disclaimer, the term of this patent is extended or adjusted under 35 U.S.C. 154(b) by 97 days.

(21) Appl. No.: 14/356,242

(22) PCT Filed: May 15, 2012

(86) PCT No.: PCT/EP2012/002077

§ 371 (c)(1),
(2), (4) Date: Jun. 23, 2014

(87) PCT Pub. No.: WO2013/068053

PCT Pub. Date: May 16, 2013

(65) Prior Publication Data

US 2014/0347876 A1 Nov. 27, 2014

(30) Foreign Application Priority Data

Nov. 11, 2011 (DE) ..... 10 2011 118 271

(51) Int. Cl.
*F21V 5/04* (2006.01)
*F21S 8/10* (2006.01)

(52) U.S. Cl.
CPC ..... *F21S 48/1225* (2013.01); *F21S 48/1241* (2013.01); *F21S 48/1266* (2013.01); *F21S 48/1275* (2013.01); *F21V 5/04* (2013.01)

(58) Field of Classification Search
CPC ..... F21S 48/125–48/1291; F21V 5/00; F21V 5/007; F21V 5/008; F21V 5/04; F21V 5/043; F21V 5/041; F21V 5/08
See application file for complete search history.

(56) References Cited

U.S. PATENT DOCUMENTS 5,257,168 A 10/1993 Davenport et al.
5,697,690 A 12/1997 Okuchi et al.
(Continued)

FOREIGN PATENT DOCUMENTS

DE 1165514 B 9/1964
DE 4121673 A1 1/1993
(Continued)

OTHER PUBLICATIONS

PCT International Search Report and Written Opinion completed by the ISA/EP on Aug. 3, 2012 and issued in connection with PCT/EP2012/002077.
(Continued)

*Primary Examiner* — Mariceli Santiago
(74) *Attorney, Agent, or Firm* — Barnes & Thornburg LLP

(57) ABSTRACT

The invention relates to a headlight lens for a vehicle headlight, more particularly for a motor vehicle headlight, wherein the headlight lens has a body composed of a transparent material, wherein the body comprises a first light tunnel, which undergoes transition with a first bend into a light-conducting part, wherein the body comprises at least one second light tunnel, which undergoes transition with the second bend into the light-conducting part, wherein the body or the light-conducting part has a first optically active light exit surface for imaging the first bend as a bright-dark boundary, and wherein the body or the light-conducting part has a second optically active light exit surface for imaging the second bend as a bright-dark boundary.

20 Claims, 11 Drawing Sheets

(56) References Cited

U.S. PATENT DOCUMENTS

| | | | | |
|---|---|---|---|---|
| 6,709,141 | B1 | 3/2004 | Sisti | |
| 7,073,931 | B2 | 7/2006 | Ishida | |
| 8,342,726 | B2 | 1/2013 | Fischer et al. | |
| 2004/0156209 | A1 | 8/2004 | Ishida | |
| 2005/0088758 | A1* | 4/2005 | Minano | F21S 48/1241 359/726 |
| 2006/0087860 | A1 | 4/2006 | Ishida | |
| 2007/0018181 | A1* | 1/2007 | Steen | B60Q 1/072 257/98 |
| 2007/0147055 | A1 | 6/2007 | Komatsu | |
| 2007/0201241 | A1 | 8/2007 | Komatsu | |
| 2008/0198574 | A1* | 8/2008 | Woodward | F21S 48/1154 362/85 |
| 2010/0033849 | A1 | 2/2010 | Seki et al. | |
| 2011/0148280 | A1 | 6/2011 | Kishimoto et al. | |
| 2012/0275173 | A1* | 11/2012 | Hamm | B60Q 1/1423 362/487 |

FOREIGN PATENT DOCUMENTS

| | | | |
|---|---|---|---|
| DE | 4209957 | A1 | 9/1993 |
| DE | 4320554 | A1 | 12/1993 |
| DE | 19526512 | A1 | 1/1996 |
| DE | 19742159 | A1 | 1/1998 |
| DE | 10315131 | A1 | 10/2004 |
| DE | 20320546 | U1 | 4/2005 |
| DE | 202004005936 | U1 | 4/2005 |
| DE | 102005009556 | A1 | 9/2005 |
| DE | 102004043706 | A1 | 4/2006 |
| DE | 102004048500 | A1 | 4/2006 |
| DE | 102005011760 | A1 | 9/2006 |
| DE | 102008026626 | A1 | 12/2009 |
| DE | 10252228 | B4 | 1/2010 |
| DE | 102008049168 | A1 | 4/2010 |
| DE | 102009008631 | A1 | 8/2010 |
| EP | 1113216 | A2 | 7/2001 |
| EP | 1357333 | A2 | 10/2003 |
| EP | 1357334 | A1 | 10/2003 |
| EP | 1666787 | A1 | 6/2006 |
| EP | 1767398 | A1 | 3/2007 |
| EP | 1514148 | B1 | 1/2008 |
| EP | 2113222 | A1 | 11/2009 |
| EP | 2159479 | A2 | 3/2010 |
| EP | 2221219 | A1 | 8/2010 |
| FR | 2804494 | | 8/2001 |
| FR | 2860280 | A1 | 9/2004 |
| GB | 2365962 | A | 2/2002 |
| GB | 2399622 | B | 8/2005 |
| GB | 2412159 | A | 9/2005 |
| JP | 2005317226 | | 11/2005 |
| WO | 2004007241 | A2 | 1/2004 |
| WO | 2009/109209 | A1 | 9/2009 |
| WO | 2009/147070 | A1 | 12/2009 |
| WO | 2012072193 | A2 | 6/2012 |

OTHER PUBLICATIONS

International Preliminary Report on Patentability (Chapter I) issued on Jun. 4, 2013 in connection with PCT/EP2011/005698.
International Preliminary Report on Patentability (Chapter I) issued on Jun. 4, 2013 in connection with PCT/EP2011/005699.
International Preliminary Report on Patentability (Chapter I) issued on Jun. 4, 2013 in connection with PCT/EP2011/005700.
International Preliminary Report on Patentability (Chapter I) issued on Jun. 4, 2013 in connection with PCT/EP2011/005701.
International Preliminary Report on Patentability (Chapter I) issued on Jun. 4, 2013 in connection with PCT/EP2011/005702.
International Preliminary Report on Patentability (Chapter I) issued on Jun. 4, 2013 in connection with PCT/EP2011/005703.
PCT International Search Report completed by the ISA/EP Feb. 1, 2012 and issued in connection with PCT/EP2011/005698.
PCT International Search Report completed by the ISA/EP Mar. 19, 2012 and issued in connection with PCT/EP2011/005699.
International Preliminary Report on Patentability (Chapter I) issued on Jun. 4, 2013 in connection with PCT/EP2011/00569.
PCT International Search Report completed by the ISA/EP Feb. 15, 2012 and issued in connection with PCT/EP2011/005700.
PCT International Search Report completed by the ISA/EP Feb. 1, 2012 and issued in connection with PCT/EP2011/005701.
PCT International Search Report completed by the ISA/EP May 9, 2012 and issued in connection with PCT/EP2011/005702.
PCT International Search Report completed by the ISA/EP May 4, 2012 and issued in connection with PCT/EP2011/005703.
Takahashi, et al. "Laser Headlight" for Next Generation Automotive Lighting. ISAL-2011 Proceedings pp. 271-283.

* cited by examiner

HEADLIGHT LENS FOR A VEHICLE HEADLIGHT

CROSS-REFERENCE TO RELATED APPLICATIONS

This is a U.S. National Stage Application of PCT/EP2012/002077 filed May 15, 2012, the contents of which are hereby incorporated herein by reference.

FIELD OF THE INVENTION

The invention relates to a headlight lens for a vehicle headlight as well as to a vehicle headlight including a headlight lens, which has a monolithic body of transparent material including at least one light entry face and at least one optically operative light exit face and/or as 'effective' light exit face.

DE 10 2004 043 706 A1 discloses an optical system for a motor vehicle headlight for dispersing a beam of light rays from an illuminant, with an optical primary element having an optical face including a break or discontinuity extending along a line, being provided, wherein the optical face is formed smooth at least on one side adjacent the discontinuity so that the beam of light rays is separated into two partial beams of light rays. Herein, it is provided that at least one of the partial beams of light rays has a sharp edge of limitation. Moreover, the optical system comprises an optical secondary element for imaging the sharp edge of limitation on to a predetermined light-dark-boundary (also termed as bright-dark-boundary).

EP 1 357 333 A2 discloses a light source device for a vehicle light which has an element emitting semiconductor light, which element is arranged on an optical axis of the light source device and emits its light essentially in an orthogonal direction with regard to the optical axis.

DE 195 26 512 A1 discloses an illumination device for vehicles, wherein a light conductor of light-transmissive material having a predetermined light refractory index is arranged between the light exit end of an optical lead and a light entry end of a lens body. Herein, the light conductor is shaped such that it covers the total surface of the exit light end of the optical lead and has a light exit face which is shaped such that it is suited for forming an illumination pattern.

DE 102 52 228 A1 discloses a headlight for a motor vehicles comprising a light source as well as a light termination body associated with the light source and having a light entry face for making light emitted from the light source enter, and a light exit face as well as a lens which cooperates with the light exit face and is arranged in the light emitting direction following the light termination body.

Further illumination means in context with the vehicles are disclosed by DE 42 09 957 A1, DE 41 21 673 A1, DE 43 20 554 A1, DE 10 2009 008 631 A1, U.S. Pat. No. 5,257,168, DE 103 15 131 A1, DE 20 204 005 936, DE 203 20 546 U1 and U.S. Pat. No. 5,697,690.

It is an object to suggest an improved headlight lens for a vehicle headlight, in particular for a motor vehicle headlight. It is a further object to reduce the costs for manufacturing vehicle headlights. It is a further object to reduce the costs for manufacturing vehicles. It is a still further object to suggest a vehicle having particularly compact dimmed headlights.

SUMMARY

The aforementioned object is achieved by, for example, a headlight lens for a vehicle headlight, in particular for a motor vehicle headlight, the vehicle headlight lens comprising a blank-molded, monolithic body from transparent material, wherein the body comprises a first light tunnel, which light tunnel, via a first bend, passes over/transits/forms a transition to a light passage (or conductive) section, wherein the blank-molded monolithic body comprises at least one second light tunnel, which second light tunnel, via a second bend, passes over/transits/forms a transition to the light passage section, wherein the blank-molded monolithic body and/or the light passage section, respectively, comprises a first optically effective/operative (convex) light exit surface for imaging the first bend as a bright-dark-boundary, and wherein the blank-molded monolithic body and/or the light passage section, respectively, comprises a second optically effective/operative (convex) light exit surface for imaging the second bend as a light (bright)-dark-boundary.

An optically (operative or) effective light entry surface and/or an optically (operative or) effective light exit surface, respectively, is (constituted by), for example, an optically (operative or) effective surface of the blank-molded monolithic body. In the sense of the invention, an optically operative surface is a surface of the transparent body, at which surface, when using the headlight lens according to its purpose light will be refracted. In the sense of the invention, an optically operative surface is a surface at which, when using the headlight lens according to its purpose the direction of light which passes through this surface will be changed.

Transparent material (also given as blank-molding) is particularly glass. Transparent material is particularly inorganic glass. Transparent material is particularly silicate glass. Transparent material is particularly glass as described in Document PCT/EP2008/010136. For example, glass comprises 0.2 to 2% by weight $Al_2O_3$
0.1 to 1% by weight $Li_2O$,
0.3 (in particular 0.4) to 1.5% by weight $Sb_2O_3$
60 to 75% by weight $SiO_2$,
3 to 12% by weight $Na_2O$,
3 to 12% by weight $K_2O$, and
3 to 12% by weight CaO.

The term blank molding is to be understood in a manner that an optically operative surface is to be molded under pressure such that any subsequent finishing or post-treatment of the contour of this optically operative surface may be dispensed with or does not apply or will not have to be provided for, respectively. Consequently, it is provided for that, after blank-molding, the light exit face is not ground, i.e. it will not (have to) be treated by grinding.

A light tunnel is, for example, characterized in that essentially total reflection takes place by/at its lateral (in particular top, bottom, right and/or left) surfaces, so that light entering the light entry face is conducted (guided) through the tunnel as a light guide (conductor). A light tunnel is, for example, a light guide or light conductor. It is provided for that total reflection is achieved at the longitudinal surfaces of the light tunnel. It is, for example, provided for that the longitudinal surfaces of the light tunnel are adapted for total reflection. It is, for example, provided for that total reflection is achieved by/at the surfaces of the light tunnel essentially oriented in the direction of the optical axis of the light tunnel. It is, for example, provided for that the surfaces of the light tunnel essentially oriented in the direction of the optical axis of the light tunnel are provided for total reflection. A light tunnel advantageously tapers in the direction of its light entry face. A light tunnel advantageously tapers in the direction of its light entry face by at least 3°. A light tunnel tapers advantageously in the direction of its light entry face by at least 3° with respect to its optical axis. A light tunnel tapers advantageously at least partially in the direction of its light entry face. A light tunnel favourably tapers at least partially in the direction of its light entry face by at least 3°. A light tunnel tapers advantageously at least partially in the direction of its light entry face by at least 3° with respect to its optical axis.

A bend is, for example, a curved transition. A bend is, for example, a curved transition having a radius of curvature of no less than 50 nm. It is, for example, provided for that the surface of the headlight lens has no break or discontinuity in the bend, but rather a curve or curvature. It is, for example, provided for that the surface of the headlight lens in the bend has a curvature with a radius of curvature of the curve in the bend of no less than 50 nm. In an advantageous embodiment the radius of curvature is no larger than 5 mm (for implementing fog light). In an expedient embodiment the radius of curvature is no more than 0.25 mm (for implementing dimmed light), in particular no more than 0.15 mm, advantageously no more than 0.1 mm. In a further advantageous embodiment of the invention the radius of curvature of the curve in the bend is at least 0.05 mm. It is, for example, provided for that the surface of the headlight lens is blank-molded in the region of the bend.

In a yet further advantageous embodiment, the second optically effective (convex) light exit face comprises, for example, an optical axis which is inclined, with respect to an optical axis of the first optically effective (convex) light exit face, advantageously by at least 0.5°, in particular by at least 4°.

In a further advantageous embodiment the, for example, blank-molded, particularly monolithic body comprises at least one third light tunnel, which third light tunnel, via a third bend, passes over to the light passage section, wherein the in particular blank-molded, monolithic body and/or the light passage section, respectively, comprises a third optically effective or operative (convex) light exit surface for imaging the third bend as a bright-dark-boundary.

In a further advantageous embodiment the third optically effective (convex) light exit face comprises an optical axis which is inclined, with respect to an optical axis of the first optically effective (convex) light exit face, advantageously by at least 0.5°, in particular by at least 4°. In a further advantageous embodiment the third optically effective (convex) light exit face comprises an optical axis which is inclined, with respect to an optical axis of the second optically effective (convex) light exit face, advantageously by at least 0.5°, in particular by at least 4°.

In a further advantageous embodiment the first light tunnel is arranged between the first bend and a first light entry face. In a further advantageous embodiment the light passage section is arranged between the first bend and the first light exit face. In particular, it is provided for that light, which enters the transparent body through the first light entry face and enters the passage section from the first light tunnel in the area of the first bend, will exit from the first light exit face at an angle of between −20° and 20° with regard to the optical axis of the first light exit face. It is, for example, provided for that light which enters the transparent body through the first light entry face will exit from the first light exit face at an angle of between −20° and 20° with regard to the optical axis of the first light exit face. It is, for example, provided for that light which enters the transparent body through the first light entry face and enters the light passage section from the first light tunnel in the area of the first bend, will exit from the first light exit face essentially in parallel to the optical axis of the first light exit face. It is, for example, provided for that light, which enters the transparent body through the first light entry face will exit from the first light exit face essentially in parallel to the optical axis of the first light exit face.

In a further advantageous embodiment the first bend includes an opening angle of at least 90°. In a further expedient embodiment the first bend includes an opening angle of no more than 150°. In a further favourable embodiment the first bend is arranged on a surface of the light passage section, which surface is facing the first light entry surface.

In a further advantageous embodiment the orthogonal of the first light entry face is inclined with respect to the optical axis of the light passage section and with respect to the optical axis of the first light exit face, respectively. In a further expedient embodiment the first light entry face is inclined with respect to an optical axis of the light passage section or to the optical axis of the light passage section and, with respect to the optical axis of the first light exit face, respectively, at an angle of between 5° and 70°, in particular a tan angle of between 20° and 50°.

In a further advantageous embodiment the first light tunnel comprises a region on its surface which essentially corresponds to a part of the surface of an ellipsoid. In a further expedient embodiment the first light tunnel comprises a region on its surface which corresponds essentially to at least 15% of the surface of an ellipsoid.

The first light entry face is, for example, aligned such that light entering through the first light entry face will essentially exclusively exit through the first light exit face. The first light entry face is, for example, aligned such that light entering through the first light entry face will map/image the first bend by means of the light passage section and the first light exit face, respectively, as a light-dark-boundary.

In a further advantageous embodiment the second light tunnel is arranged between the first bend and a second light entry face. In a further advantageous embodiment the light passage section is arranged between the second bend and the second light exit face. It is, for example, provided for that light, which enters the transparent body through the second light entry face and enters the passage section from the second light tunnel in the area of the second bend, will exit from the second light exit face at an angle of between −20° and 20° with regard to the optical axis of the second light exit face. It is, for example, provided for that light which enters the transparent body through the second light entry face will exit from the second light exit face at an angle of between −20° and 20° with regard to the optical axis of the second light exit face. It is, for example, provided for that light which enters the transparent body through the second light entry face and enters the light passage section from the second light tunnel in the area of the second bend, will exit from the second light exit face essentially in parallel to the optical axis of the second light exit face. It is, for example, provided for that light, which enters the transparent body through the second light entry face will exit from the second light exit face essentially in parallel to the optical axis of the second light exit face.

In a further advantageous embodiment the second bend includes an opening angle of at least 90°. In a further expedient embodiment the second bend includes an opening angle of no more than 150°. In a further favourable embodiment of the invention the second bend is arranged on a surface of the light passage section, which surface is facing the second light entry face.

In a further advantageous embodiment the orthogonal of the second light entry face is inclined with respect to an optical axis of the light passage section and/or with respect to the optical axis of the second light exit face. In a further expedient embodiment the second light entry face is inclined with respect to the optical axis of the light passage section and, with respect to the optical axis of the second light exit face, respectively, at an angle of between 5° and 70°, in particular at an angle of between 20° and 50°.

In a further advantageous embodiment the second light tunnel comprises a region on its surface which essentially corresponds to a part of the surface of an ellipsoid. In a further expedient embodiment the second light tunnel comprises a region on its surface which corresponds essentially to at least 15% of the surface of an ellipsoid.

The second light entry face is, for example, aligned such that light entering through the second light entry face will essentially exclusively exit through the second light exit face. The second light entry face is, for example, aligned such that light entering through the second light entry face will map/image the second bend by means of the light passage section and the second light exit section, respectively, as a bright-dark-boundary.

In a further advantageous embodiment the third light tunnel is arranged between the third bend and a third light entry face. In a further advantageous embodiment the light passage section is arranged between the third bend and the third light exit face. It is, for example, provided for that light, which enters the transparent body through the third light entry face and enters the passage section from the third light tunnel in the area of the third bend, will exit from the third light exit face at an angle of between −20° and 20° with regard to the optical axis of the third light exit face. It is, for example, provided for that light which enters the transparent body through the third light entry face will exit from the third light exit face at an angle of between −20° and 20° with regard to the optical axis of the third light exit face. It is, for example, provided for that light which enters the transparent body through the third light entry face and enters the light passage section from the third light tunnel in the area of the third bend, will exit from the third light exit face essentially in parallel to the optical axis of the third light exit face. It is, for example, provided for that light, which enters the transparent body through the third light entry face will exit from the third light exit face essentially in parallel to the optical axis of the third light exit face.

In a further advantageous embodiment the third bend includes an opening angle of at least 90°. In a further expedient embodiment the third bend includes an opening angle of no more than 150°. In a further favourable embodiment the third bend is arranged on a surface of the light passage section, which surface is facing the third light entry face.

In a further advantageous embodiment the orthogonal of the third light entry face is inclined with respect to an optical axis of the light passage section and with respect to the optical axis of the third light exit face, respectively. In a further expedient embodiment the third light entry face of is inclined with respect to the optical axis of the light passage section and, with respect to the optical axis of the third light exit face, respectively, at an angle of between 5° and 70°, in particular at an angle of between 20° and 50°.

In a further advantageous embodiment the third light tunnel comprises a region on its surface which essentially corresponds to a part of the surface of an ellipsoid. In a further expedient embodiment the third light tunnel comprises a region on its surface which corresponds essentially to at least 15% of the surface of an ellipsoid.

The third light entry face is, for example, aligned such that light entering through the third light entry face will essentially exclusively exit through the third light exit face. The third light entry face is, for example, aligned such that light entering through the third light entry face will map/image the third bend by means of the light passage section and the third light exit section, respectively, as a light-dark-boundary.

In a yet further advantageous embodiment the first, second, and/or third light tunnel comprises a region on its surface, for which the following applies:

$$0{,}75\cdot a\cdot\sqrt{1-\frac{y^2}{b^2}-\frac{z^2}{c^2}}\le x\le 1{,}25\cdot a\cdot\sqrt{1-\frac{y^2}{b^2}-\frac{z^2}{c^2}}$$

$$0{,}75\cdot b\cdot\sqrt{1-\frac{x^2}{a^2}-\frac{z^2}{c^2}}\le y\le 1{,}25\cdot b\cdot\sqrt{1-\frac{x^2}{a^2}-\frac{z^2}{c^2}},$$

in which z is a coordinate in the direction (of the optical axis) of the first, second, and/or third light tunnel, respectively;

x is a coordinate orthogonal to the direction of the optical axis of the first, second, and/or third light tunnel, respectively;

y is a coordinate orthogonal to the direction of the optical axis of the first, second, and/or third light tunnel, respectively;

a is a number having a value greater than 0;

b is a number having a value greater than 0; and c is a number having a value greater than 0.

In a further advantageous embodiment a surface of the light passage section facing the first, second, and/or third light tunnel(s) is/are curved at least in the region of the first, second, and/or third bend(s) towards the transition into the first, second, and/or third light tunnel(s), the curvature being, in particular, convex. In a further advantageous embodiment the first, second, and/or third bend(s) is/are curved in its/their longitudinal extension(s). In a further advantageous embodiment the first, second, and/or third bend(s) is/are curved, in its/their longitudinal extension(s), having a radius of curvature of between 5 mm and 100 mm. In a still further advantageous embodiment the first, second, and/or third bend(s) is/are curved, in its/their longitudinal extension(s), corresponding to a Petzval curve (also termed Petzval [sur] face).

In a further expedient embodiment the first, second, and/or third bend as(s) comprise/s, in its/their longitudinal extension(s), a curvature having a radius of curvature in the orientation of the optical axis of the first, second, and/or third light tunnel(s) and/or of the light passage section. In a yet further preferred embodiment the radius of curvature is orientated opposite to the first, second, and/or third light exit faces.

In a further advantageous embodiment the first, second, and/or third bend(s) is/are curved in a first direction and in a second direction. In a further expedient embodiment the first direction is orthogonal to the second direction. In a still further advantageous embodiment the first, second, and/or third bend(s) is/are curved with a first radius of curvature in a first direction and with a second radius of curvature in a second direction, wherein the second radius of curvature is positioned orthogonal to the first radius of curvature.

In a further advantageous embodiment a portion of the surface of the passage section facing the first, second, and/or third light tunnel(s) is designed as a Petzval face. In a yet further advantageous embodiment the surface of the light passage section facing the first, second, and/or third light tunnel(s) is, in a region in which it forms a transition into the first, second, and/or third light tunnel(s), designed as a Petzval face.

In a further advantageous embodiment the length of the headlight lens, when viewed in the orientation of the optical axis of the first, second, and/or third light tunnel(s) and/or the light passage section, amounts to no more than 7 cm.

The aforementioned object is moreover achieved by a vehicle headlight, in particular a motor vehicle headlight, which comprises an aforementioned headlight lens as well as a light source for making light enter the light entry face of the first light tunnel, a light source for making light enter the light entry face of the second light tunnel, and/or a light source for making light enter the light entry face of the third light tunnel.

In a further expedient embodiment the vehicle headlight has no secondary optic associated with the headlight lens. A secondary optic is, an optic for aligning light which exits from the light exit face or from the last light exit face, respectively. A secondary optic is an optical element for aligning light separated from and/or subordinated with regard to the headlight lens. A secondary optic is no cover or protection disc, respectively, but an optical element provided for aligning light. An example of a secondary optic is e.g. a secondary lens as has been disclosed in DE 10 2004 043 706 A1.

There is, for example, provided that the first, second, and/or third bend(s) which is/are imaged as bright-dark-boundary lies in the lower region of the first, second, and/or third light tunnel(s).

In a further expedient embodiment the optical axis of the first light exit face extends in a(n) (essentially) horizontal plane. In a further expedient embodiment the optical axis of the second light exit face extends in a(n) (essentially) horizontal plane. In a further expedient embodiment the optical axis of the third light exit face extends in a(n) (essentially) horizontal plane.

The distance between the light source associated with the first light entry face and the first light entry face amounts to particularly less than 1 cm. The distance between the light source associated with the second light entry face and the second light entry face amounts to particularly less than 1 cm. The distance between the third light source associated with the third light entry face and the third light entry face amounts to particularly less than 1 cm.

In a yet further advantageous embodiment the distance of the light source associated with the first light entry face from the centre of the first light exit face, when seen in the orientation of the optical axis of the first light tunnel amounts to no more than 10 cm. In a still further advantageous embodiment the length of the vehicle headlight, when seen in the orientation of the optical axis of the first light tunnel and/or the light passage section amounts to no more than 10 cm. In a yet further advantageous embodiment the distance of the light source associated with the second light entry face from the centre of the second light exit face, when viewed in the orientation of the optical axis of the second light tunnel, amounts to no more than 10 cm. In a still further advantageous embodiment of the invention the length of the vehicle headlight, when viewed in the orientation of the optical axis of the second light tunnel and/or the light passage section amounts to no more than 10 cm. In a yet further advantageous embodiment the distance of the light source associated with the third light entry face from the centre of the third light exit face, when seen in the orientation of the optical axis of the third light tunnel amounts to no more than 10 cm. In a still further advantageous embodiment the length of the vehicle headlight, when viewed in the orientation of the optical axis of the third light tunnel and/or the light passage section amounts to no more than 10 cm.

In a further expedient embodiment a further light source for making light enter or irradiating light, respectively, into the corresponding light tunnel and/or immediately into the light passage section, is associated with the first light tunnel and/or the second light tunnel and/or the third light tunnel. In a further expedient embodiment a further light source for making light enter or irradiating light, respectively, into the surface of the light passage section facing the corresponding light tunnel, is associated with the first light tunnel and/or the second light tunnel and/or the third light tunnel. In a further expedient embodiment light is irradiated, by means of the further light source, above and/or below the bright-dark-boundary.

In a furthermore expedient embodiment a corner light source, arranged, in particular, to the left of the optical axis of the corresponding light tunnel and/or above the optical axis of the corresponding light tunnel and/or the right of the light tunnel (as such), is associated with the first light tunnel and/or the second light tunnel and/or the third light tunnel.

In a furthermore advantageous embodiment a partial light source, arranged above the corresponding light tunnel, is associated with the first light tunnel and/or the second light tunnel and/or the third light tunnel. In a furthermore expedient embodiment at least two partial light sources, arranged above the corresponding light tunnel and spatially separated from one another, are associated with the first light tunnel and/or the second light tunnel and/or the third light tunnel.

In a furthermore advantageous embodiment a partial light source, arranged below the corresponding light tunnel, is associated with the first light tunnel and/or the second light tunnel and/or the third light tunnel. In a furthermore expedient embodiment at least two partial light sources, arranged below the corresponding light tunnel and spatially separated from one another, are associated with the first light tunnel and/or the second light tunnel and/or the third light tunnel.

In an advantageous embodiment a light source, a corner light source and/or a partial light source include/s at least one LED or an array of LEDs. In an expedient embodiment the light source comprises at least one OLED or an array of OLEDs. For example the light source may well be a plane/planar luminous field. The light source may also include light element chips as have been disclosed by DE 103 15 131 A1. A light source may as well be a laser. A suitable laser has been disclosed in ISAL 2011 Proceedings, page 271ff.

It may be provided for that a light entry face, in the sense of the invention, and/or a light exit face may have a light dispersing structure. A light dispersing structure may, for example, be a structure as has been disclosed in DE 10 2005 009 556 A1 and in EP 1 514 148 A1 or EP 1 514 148 B1. It may be provided for that a light tunnel is coated. It may be provided for that a light tunnel is coated with a reflective coating or layer. It may be provided for that a mirror-like reflective coating is applied to a light tunnel.

A motor vehicle is, for example, a land vehicle for individual use in road traffic. Motor vehicles are, for example, not restricted to land vehicles including a combustion engine. A motor vehicle, for example, comprises at least four wheels. A motor vehicle comprises, for example, a seat for a driver and at least one front passenger seat arranged alongside the driver's seat viewed in the transversal direction of the motor vehicle. A motor vehicle comprises, for example, at least four seats. A motor vehicle is, for example, admitted for at least four persons.

Further advantages and details may be taken from the following description of the examples of embodiments.

DETAILED DESCRIPTION OF DRAWINGS

Figure 1:
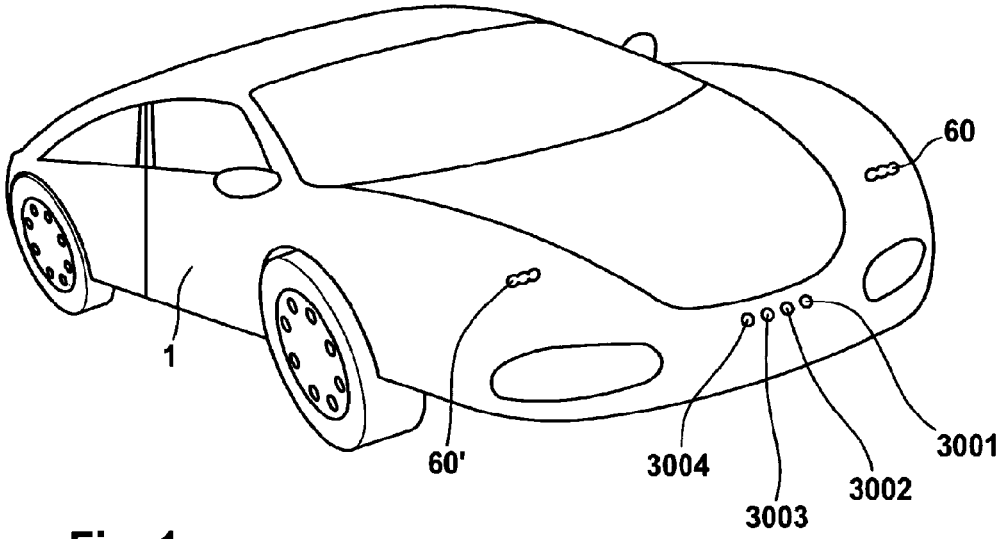
FIG. 1 shows an example of an embodiment of a motor vehicle.

FIG. 1 shows an example of embodiment of a motor vehicle 1 having motor vehicle headlights 60 and 60' as well as motor vehicle headlights/partial headlights 3001, 3002, 3003, and 3004, which are integrated in the body of the motor vehicle 1 within the central third of the front of the motor vehicle 1. The motor vehicle headlights 60 and 60' are integrated in the body of the motor vehicle 1 within the marginal area of the front of the motor vehicle 1. The partial headlights 3001, 3002, 3003, and 3004 may be substituted by a motor vehicle headlight corresponding to motor vehicle headlight 60.

Figure 2:
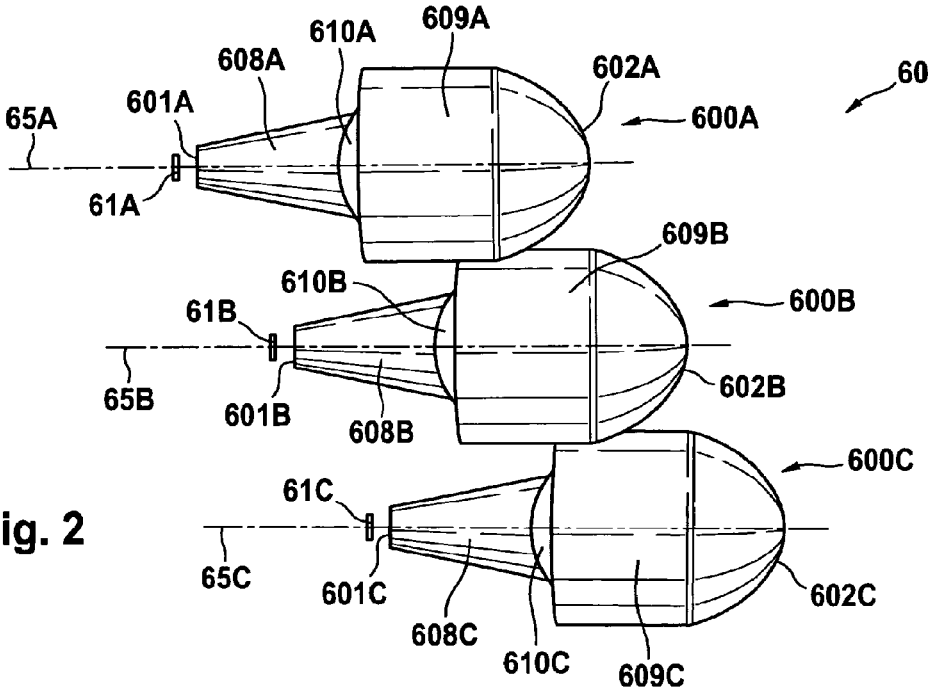
FIG. 2 shows a top view of an example of an embodiment of a motor vehicle headlight for use in the motor vehicle according to FIG. 1.

FIG. 2 shows a motor vehicle headlight 60 by way of a top view, however without any housing, fittings and energy supply. The motor vehicle headlight 60 comprises a blank-molded monolithic body made from inorganic glass, in particular glass, which comprises 0.2 to 2% by weight $Al_2O_3$
0.1 to 1% by weight $Li_2O$,
0.3, in particular 0.4 to 1.5% by weight $Sb_2O_3$
60 to 75% by weight $SiO_2$,
3 to 12% by weight $Na_2O$,
3 to 12% by weight $K_2O$, and
3 to 12% by weight CaO, wherein the blank-molded monolithic body comprises a headlight lens part 600A, a headlight lens part 600B, and a headlight lens part 600C.

The headlight lens part 600A comprises a light tunnel 608A, which, on its one side, has a light entry face 601A and, on another side (on the lower side of the headlight lens part 600A), passes over/transits into a light passage (or conductive) section 609A of the headlight lens part 600A via a bend curved in two spatial directions, wherein the light passage section 609A has a light exit face 602A. The headlight lens part 600A is designed such that light entering the headlight lens 600A through the light entry face 601A and, in the region of the bend enters the light passage section 609A from the light tunnel 608A will exit from the light exit face 602A essentially in parallel to the optical axis 65A of the headlight lens part 600A. Herein, the light passage section 609A images the bend as a bright-dark-boundary. A portion of the surface of the light passage section 609A facing the light tunnel 608A is designed as a Petzval surface, said surface portion having been designated by reference numeral 610A. The motor vehicle headlight 60 comprises a light source 61A designed as an LED, by means of which, for the purpose of implementing dimmed headlights, light is irradiated into or made to enter, respectively, the light entry face 601A of light tunnel 608A.

The headlight lens part 600B comprises a light tunnel 608B, which, on its one side, has a light entry face 601B and, on another side (on the lower side of the headlight lens part 600B), passes over/transits into a light passage (or conductive) section 609B of the headlight lens part 600B via a bend curved in two spatial directions, wherein the light passage section 609B has a light exit face 602B. The headlight lens part 600B is designed such that light entering the headlight lens 600B through the light entry face 601B and, in the region of the bend enters the light passage section 609B from the light tunnel 608B will exit from the light exit face 602B essentially in parallel to the optical axis 65B of the headlight lens part 600B. Herein, the light passage section 609B images the bend as a bright-dark-boundary. A portion of the surface of the light passage section 609B facing the light tunnel 608B is designed as a Petzval surface, said surface portion having been designated by reference numeral 610B. Motor vehicle headlight 60 comprises a light source 61B designed as an LED, by means of which, for the purpose of implementing dimmed headlights, light is irradiated into or made to enter, respectively, light entry face 601B of light tunnel 608B.

The headlight lens part 600C comprises a light tunnel 608C, which, on its one side, has a light entry face 601C and, on another side (on the lower side of the headlight lens part 600C), passes over into a light passage (or conductive) section 609C of the headlight lens part 600C via a bend curved in two spatial directions, wherein the light passage section 609C has a light exit face 602C. The headlight lens part 600C is designed such that light entering the headlight lens 600C through the light entry face 601C and, in the region of the bend enters the light passage section 609C from the light tunnel 608C will exit from the light exit face 602C essentially in parallel to the optical axis 65C of the headlight lens part 600C. Herein, the light passage section 609C images the bend as a bright-dark-boundary. A portion of the surface of the light passage section 609C facing the light tunnel 608C is designed as a Petzval surface, said surface portion having been designated by reference numeral 610C. The motor vehicle headlight 60 comprises a light source 61C designed as an LED, by means of which, for the purpose of implementing dimmed headlights, light is irradiated into or made to enter, respectively, the light entry face 601C of light tunnel 608C.

The optical axis 65A lies in a first plane which is essentially horizontal. The optical axis 65B lies in a second essentially horizontal plane. The optical axis 65C lies in a third essentially horizontal plane. The first plane, the second plane, and the third plane extend essentially in parallel to each other. The optical axis 65A, moreover, lies in a first vertical plane. The optical axis 65B, moreover, lies in a second vertical plane. The optical axis 65C, moreover, lies in a third vertical plane. The first vertical plane is inclined by 0.5° with respect to the second vertical plane. The first vertical plane is inclined by 1° with respect to the third vertical plane. The second vertical plane is inclined by 0.5° with respect to the third vertical plane.

Figure 3:
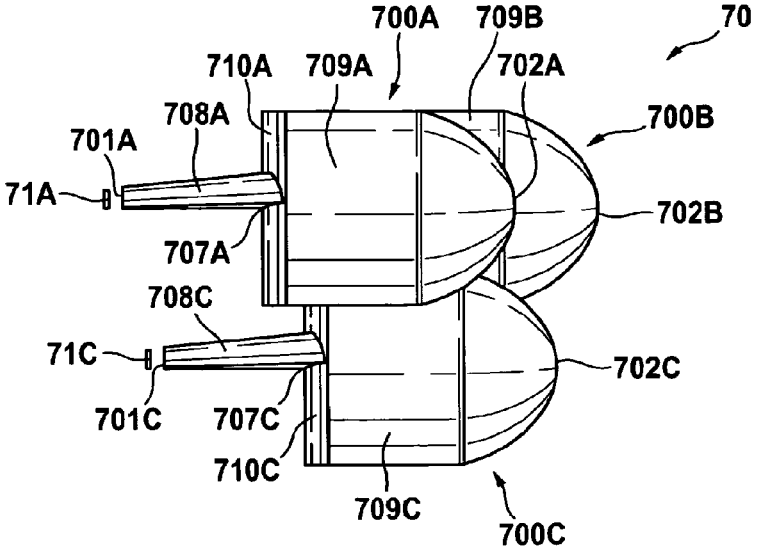
FIG. 3 shows a top view of a further example of an embodiment of a motor vehicle headlight for use in the motor vehicle according to FIG. 1.

FIG. 3 shows, by way of a top view, a motor vehicle headlight 70 alternatively to be used instead of the motor vehicle headlight 60'. The motor vehicle headlight 70 comprises a blank-molded monolithic body made of inorganic glass and comprising a headlight lens part 700A, a headlight lens part 700B, and a headlight lens part 700C.

The headlight lens part 700A comprises a light tunnel 708A, which has a light entry face 701A on one side and, on another side, transits/passes over into a light passage section 709A of the headlight lens part 700A via a bend 707A curved in two spatial dimensions, wherein the light passage section 709A includes a light exit face 702A. The headlight lens part 700A is shaped such that light which enters the headlight lens 700A through the light entry face 701A, and from the light tunnel 708A enters the light passage section 709A in the region of the bend 707A, will exit from the light exit face 702A essentially in parallel to the optical axis of the headlight lens part 700A. Herein, the light passage section 709A will image the bend 707A as a bright-dark-boundary. A portion of the surface of the light passage section 709A, which portion is facing the light tunnel 708A and has been designated by reference numeral 710A, is designed as a Petzval (sur)face. The motor vehicle headlight 70 includes a light source 71A designed as an LED, by means of which, for the implementing of dimmed light, light is irradiated into or made to enter, respectively, the light entry face 701A of the light tunnel 708A.

The headlight lens part 700B comprises a light tunnel (in FIG. 3 concealed by headlight lens part 700A), which has a light entry face (in FIG. 3 concealed by headlight lens part 700A) on one side and, on another side (on the bottom side of the headlight lens part 700B), forms a transition with a light passage section 709B of the headlight lens part 700B via a bend curved (in FIG. 3 concealed by headlight lens part 700A) in two spatial dimensions, which light passage section 709B includes a light exit face 702B. The headlight lens part 700B is shaped such that light, which enters the headlight lens 700B through the light entry face, and, in the region of the bend, enters the light cone passage section 709B from the light tunnel, will exit from the light exit face 702B essentially in parallel to the optical axis of the headlight lens part 700B. Herein, the light passage section 709B images the bend as a bright-dark-boundary. A portion (in FIG. 3 concealed by headlight lens part 700A) of the surface of the light passage section 709B, which portion is facing the light tunnel is designed as a Petzval surface. The motor vehicle headlight 70 includes a light source (in FIG. 3 concealed by headlight lens part 700A) designed as an LED, by means of which, for implementing dimmed light, light is irradiated into or made to enter, respectively, the light entry face of the light tunnel.

The headlight lens part 700C comprises a light tunnel 708C, which has a light entry face 701C on one side and, on another side (on the bottom side of the headlight lens part 700C), forms a transition into a light passage section 709C of headlight lens part 700C via a bend 707C curved in two spatial dimensions, which light passage or conductive section 709C includes a light exit face 702C. The headlight lens part 700C is designed such that light, which enters the headlight lens 700C through light entry face 701C, and, in the region of the bend 707C, enters the light passage section 709C from the light tunnel 708C, will exit from the light exit face 702C essentially in parallel to the optical axis of headlight lens part 700C. Herein, the light passage section 709C will image the bend 707C as a bright-dark-boundary. A portion of the surface of the light passage section 709C, which portion is facing the light tunnel 708C and has been designated by reference numeral 710C, is designed as a Petzval face. The motor vehicle headlight 70 includes a light source 71C designed as an LED, by means of which, for implementing dimmed light, light is irradiated into or made to enter (be coupled to), respectively, the light entry face 701C of the light tunnel 708C.

Figure 4:
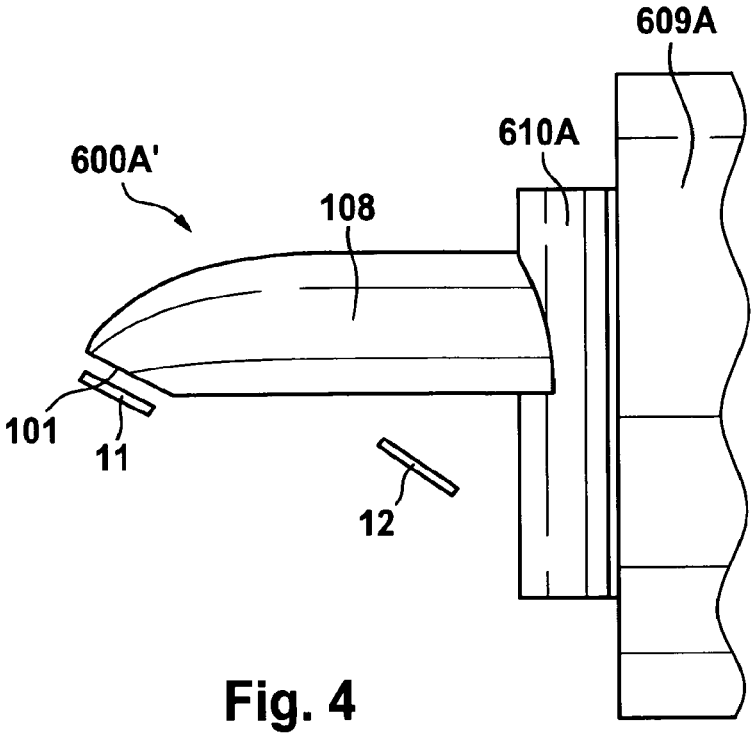
FIG. 4 shows an example of an embodiment of a modification of a motor vehicle headlight according to FIG. 2.
Figure 5:
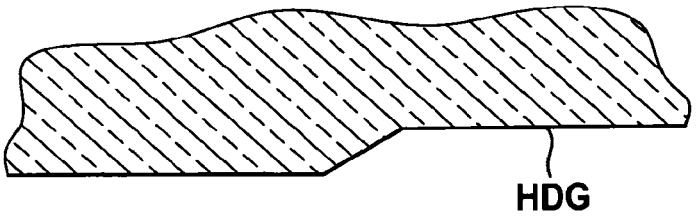
FIG. 5 shows a bright-dark-boundary generated by means of the motor vehicle headlight according to FIG. 4.
Figure 6:
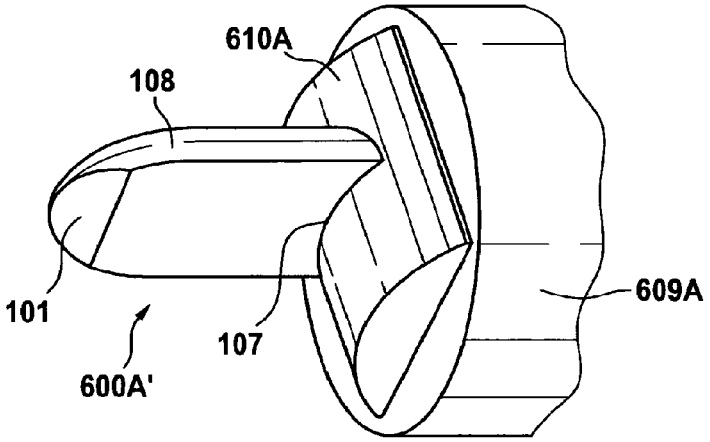
FIG. 6 shows a cut-out representation of a headlight lens portion according to FIG. 4 by way of a perspective view from below.
Figure 8:
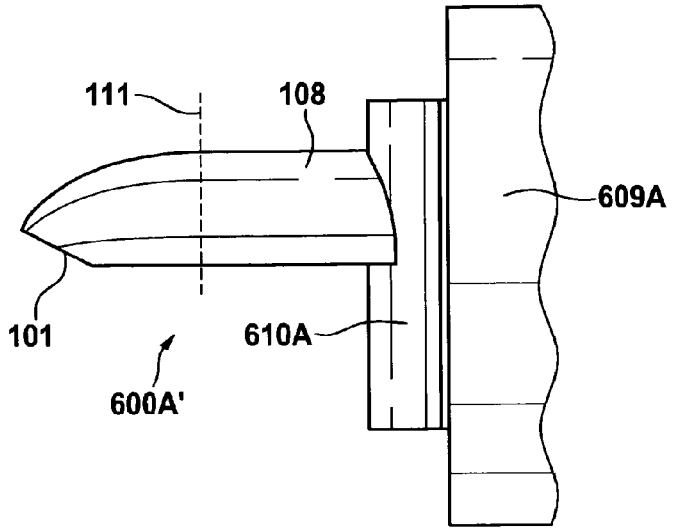
FIG. 8 shows a cut-out representation of a headlight lens according to FIG. 4 by way of a side view.

FIG. 4, FIG. 6, and FIG. 8 show a modification (concerning, only, the headlight lens part 600A or, only, the headlight lens parts 600A and 600B, or, only, the headlight lens parts 600A and 600C or the headlight lens parts 600A, 600B and 600C) of the motor vehicle headlight 60 by way of the example of headlight lens part 600A. In the following, as headlight lens part 600A' reference is made to light passage or conductive section 609A in context with the modified elements associated with light passage or conductive section 609A, i.e. the modified headlight lens part. The correspondingly modified blank-molded monolithic body comprises a light tunnel 108, which has a light entry face 101 on one side and, on the other side, forms transition into a light passage or conductive section 609A (of the blank-molded monolithic body) via a bend 107 curved in two spatial dimensions. Light, which enters the headlight lens through the light entry face 101, and from the light tunnel 108 enters the passage section 609A in the region of the bend 107, will exit from light exit face 602A essentially in parallel to the optical axis of the headlight lens part 600A'. Herein, the light passage section 609A images the bend 107—as has been shown in FIG. 8—as a bright-dark-boundary HDG. The portion of the surface of the light passage section 609A designated by reference numeral 610A and facing the light tunnel 108 is shaped as a Petzval surface (as stated above).

The corresponding motor vehicle headlight includes a light source 11 designed as an LED, and a light source 12 designed as an LED. For the purpose of implementing dimmed light, light is irradiated into or made to enter, respectively, the light entry face 101 of the light tunnel 108 by means of light source 11. By means of the selectively switchable light source 12, and for implementing sign light or drive light, light is made to enter or is irradiated into, respectively, a bottom side of the light tunnel 108 or the Petzval-face-designed portion 610A of the surface of the light passage section 609A facing the light tunnel 108.

Figure 7:
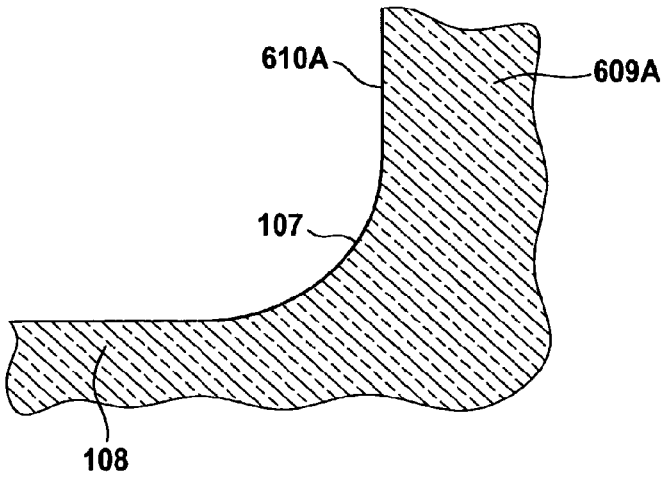
FIG. 7 shows an enlarged representation of a cut-out cross section of a bend for the transition of a light tunnel into a passage section of a headlight lens according to FIG. 4.

FIG. 7 shows, by way of an enlarged representation, a cut-out of the bend 107 for transition of the light tunnel 108 into the light passage section 609A, the bend 107 being formed by blank-molding and designed as a continuous, curved transition having a radius of curvature of at least 0.15 mm.

Figure 9:
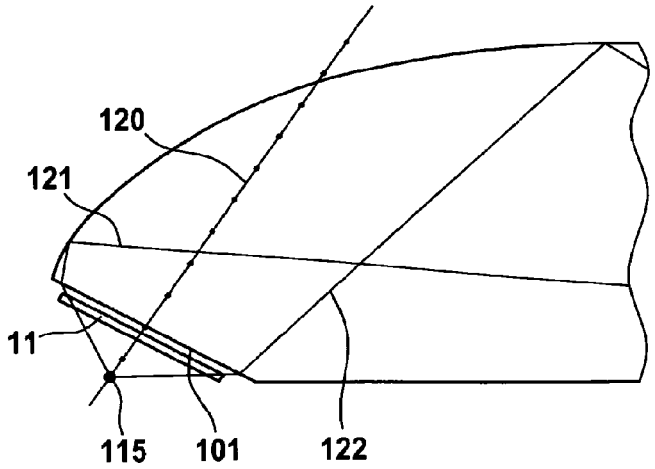
FIG. 9 shows a cut-out representation of a light tunnel of headlight lens of FIG. 4 by way of a side view.
Figure 10:
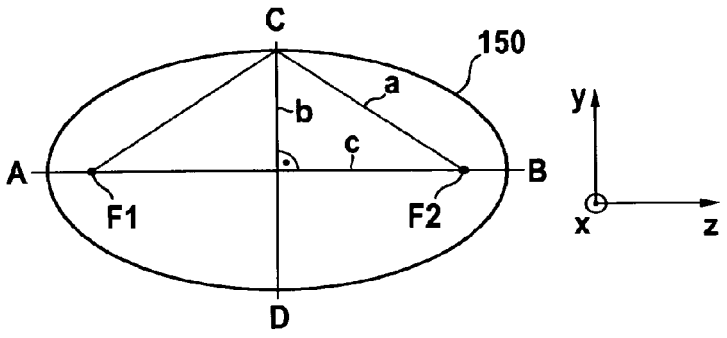
FIG. 10 shows an example of embodiment for an ellipsoid.
Figure 11:
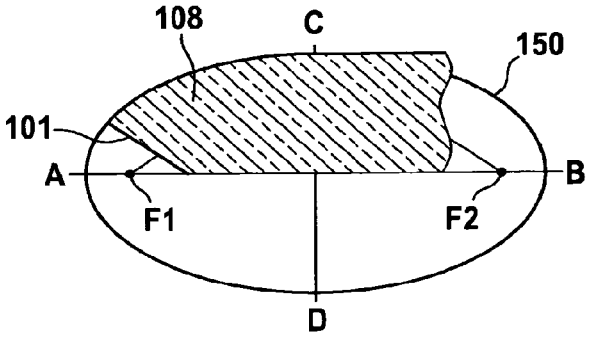
FIG. 11 shows a cross-sectional representation of the ellipsoid according to FIG. 10 with a superimposed representation of a portion of the light tunnel represented in FIG. 9.

FIG. 8 shows a cut-out representation of a side view of the headlight lens 600A'. FIG. 9 shows an enlarged cut-out representation of a part of the light tunnel 108 up to the dotted line in FIG. 8 designated by reference numeral 111. The upper portion of the part of the light tunnel as shown in FIG. 9 has been designed as an ellipsoid 150 as represented in FIG. 10. Herein, the dotted line 111 approximately corresponds to the axis C-D. For clarifying this embodiment, a part of the cross section of the light tunnel 108 in FIG. 11 is shown in a manner superimposing (overlaying) the representation of the ellipsoid 150. With regard to the ellipsoid 150 represented in FIG. 10 the following applies:

$$\frac{x^2}{a^2}+\frac{y^2}{b^2}+\frac{z^2}{c^2}-1=0$$

In this formula z is a coordinate extending in the direction of the optical axis of light tunnel 108 (A→B);

x is a coordinate extending orthogonally to the direction of the optical axis of the light tunnel 108; and y is a coordinate extending orthogonally to the direction of the optical axis of the light tunnel 108 and to the x-direction (D→C).

a, b and, consequently, c have been selected such that all light beams or rays which pass through focus F1 will concentrate again in focus F2 after mirroring in the surface of the ellipsoid. The course of the light beams of the light from the light source 11, which is irradiated into or made to enter, respectively, the light entry face 101 is illustrated by the light beams 121 and 122 depicted in FIG. 9. Reference numeral 120 of FIG. 9 designates the orthogonal of the light entry face 101. The mutual point of intersection of the orthogonal 120 of the light entry face 101 with the light beams 121 and 122 has been designated by reference numeral 115. The position of this point of intersection 115 corresponds to focus F1 in FIG. 10 and FIG. 11.

Figure 12:
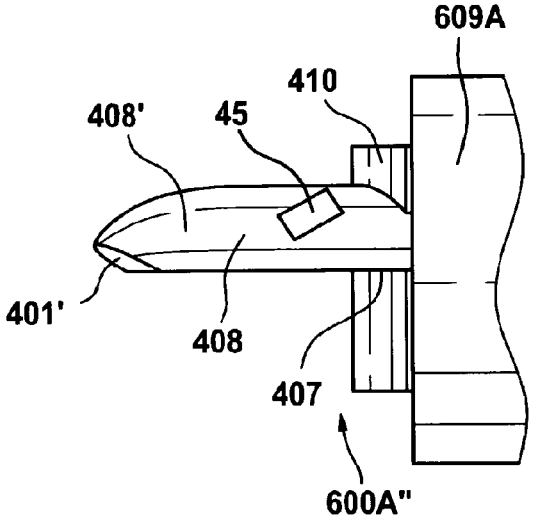
FIG. 12 shows a side view of a further alternative example of embodiment of a modified motor vehicle headlight according to FIG. 2.
Figure 13:
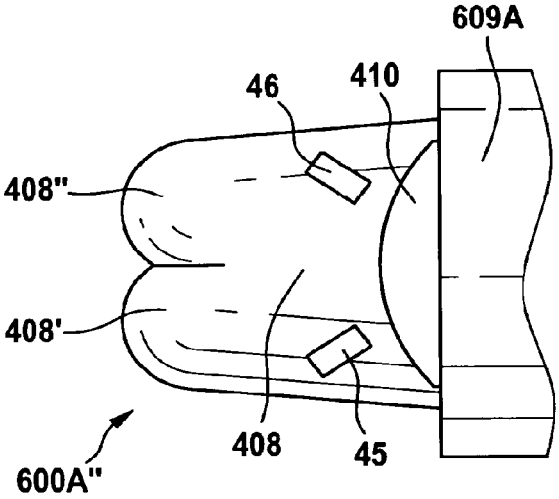
FIG. 13 shows the motor vehicle headlight according to FIG. 12 by way of a top view.

FIG. 12 (side elevation) and FIG. 13 (top view) show a further modification (concerning, only, the headlight lens part 600A or, only, the headlight lens parts 600A and 600B, or, only, the headlight lens parts 600A and 600C or the headlight lens parts 600A, 600B and 600C) of the motor vehicle headlight 60 by way of the example of headlight lens part 600A. In the following, as a headlight lens part 600A" reference is made to light passage or conductive section 609A in context with the modified elements associated with light passage or conductive section 609A, i. e. the modified headlight lens part. The correspondingly modified blank-molded monolithic body comprises a light tunnel section 408' and a light tunnel section 408", which end in a light tunnel 408, which, as such, forms a transition into the light passage or conductive section 609A (of the blank-molded monolithic body) via a bend 407 curved in two spatial dimensions. The light tunnel section 408' includes a light entry face 401'. Light tunnel section 408" has a corresponding light entry face (concealed in FIG. 12). The headlight lens part 600A" is designed such that light, which enters the headlight lens part 600A" through the light entry faces 401', and from the light tunnel 408 enters the passage section 609A in the region of the bend 407, will exit from the light exit face 602A essentially in parallel to the optical axis of the headlight lens part 600A". Herein, the light passage section 609A images the bend 407 as a bright-dark-boundary. The portion of the surface of the light passage section 609A designated by reference numeral 410 and facing the light tunnel 408 is shaped as a Petzval (sur)face.

Figure 14:
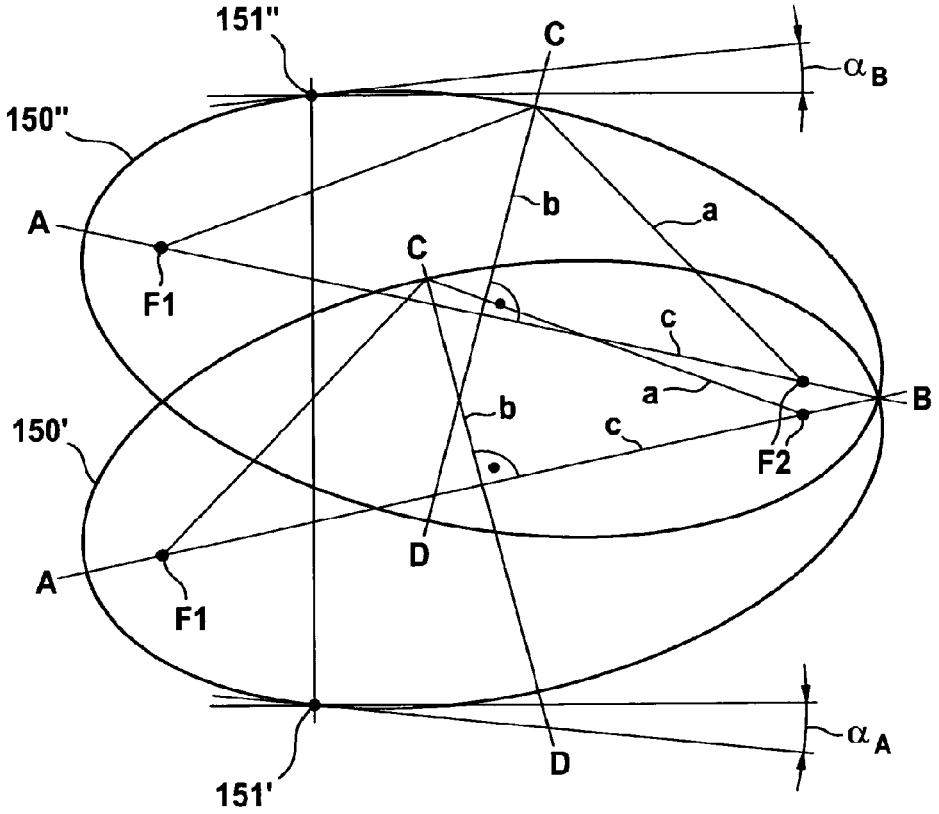
FIG. 14 shows a principle representation of an example of embodiment for the superimposition of two ellipsoids.

At least in their upper regions, the light tunnel sections 408A and 408B are designed—taken in analogy to the explanations relating to FIG. 11—as part of an ellipsoid, as has been represented in principle in FIG. 14. Herein, reference numeral 150' designates an ellipsoid associated with the light tunnel section 408', and reference numeral 150" designates an ellipsoid associated with the light tunnel section 408". The ellipsoids 150' and 150" are—as has been represented in FIG. 14—aligned in relation to each other such that the respective focuses F2 will lie on top of each other. At points designated by reference numerals 151' and 151", and/or starting at points 151' and 150", respectively, (in the direction of light propagation or towards the right, respectively) the surface contour of the headlight lens part 600A" deviates from the contour of an ellipsoid. Herein, the angles $\alpha_A$ and $\alpha_B$ indicate the directions of deviation from the elliptic shape.

The motor vehicle headlight formed while using the headlight lens part 600A" includes two light sources, which, in analogy to light source 11 have been designed as LEDs and, for the sake of clarity, have not been depicted in FIG. 12 and FIG. 13. By means of one of the light sources, and for the purpose of implementing dimmed light, light is irradiated into or made to enter, respectively, the light entry face 401' of the light tunnel section 408', and, by means of the other one of the light sources, and for the purpose of implementing dimmed light, light is irradiated into or made to enter, respectively, the light entry face of the light tunnel section 408". In addition, a non-shown the light source may be provided which corresponds to light source 12 with respect to position and performance.

In addition, and for implementing a corner light and/or a front fog light (adverse weather lamp) light sources 45 and 46 designed as LEDs are provided, with the light sources 45 and 46 being alternatively switshable for implementing the corner light. Herein, a non-shown control is provided for within the motor vehicle 1, by means of which the light source 45 is switched on for the time of driving round a left corner, and light source 46 is switched on for the time of driving round a right corner. For implementing a front fog light, either light source 46 or both light sources 45 and 46 are switched on.

Figure 15:
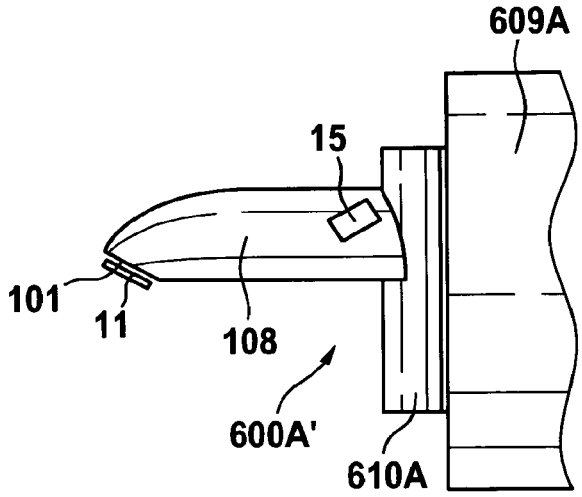
FIG. 15 shows a side view of a further example of embodiment of a motor vehicle headlight for use in the motor vehicle according to FIG. 1.
Figure 16:
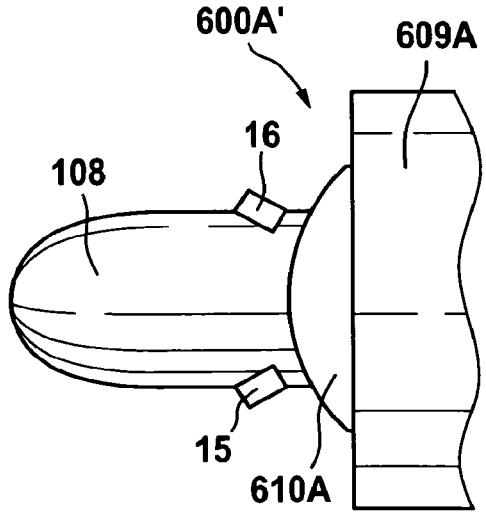
FIG. 16 shows the motor vehicle headlight according to FIG. 15 by way of a top view.

FIG. 15 (side elevation) and FIG. 16 (top view) show a further modification (concerning, only, the headlight lens part 600A or, only, the headlight lens parts 600A and 600B, or, only, the headlight lens parts 600A and 600C or the headlight lens parts 600A, 600B and 600C) of the motor vehicle headlight 60 by using the headlight lens part 600A'. In addition to light source 11, for implementing a corner (or curve) light and/or a front fog light, light sources 15 and 16 designed as LEDs have been provided. It may as well be provided for that, in addition, light source 12 is implemented within the corresponding motor vehicle headlight.

For implementing a corner light the light sources 15 and 16 may be switched on alternatively. Herein, a non-shown control means is provided for in the motor vehicle 1, by means of which the light source 15 may be switched on for the time of driving round a left corner and light source 16 may be switched on for the time of driving round a right corner. For implementing a front fog light either the light source 16, only, or both light sources 15 and 16 are switched on.

Figure 17:
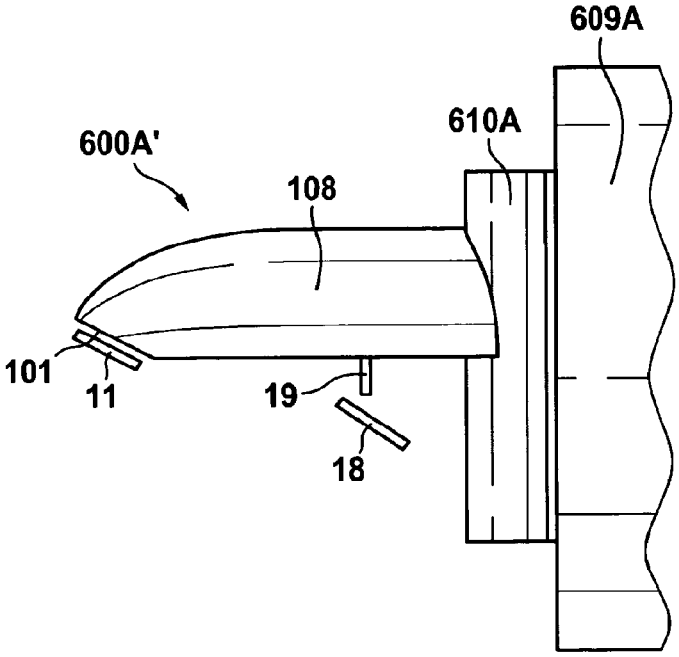
FIG. 17 shows a side view of a further example of an embodiment of a motor vehicle headlight for use in the motor vehicle according to FIG. 1.

FIG. 17 shows a further modification (concerning, only, the headlight lens part 600A or, only, the headlight lens parts 600A and 600B, or, only, the headlight lens parts 600A and 600C or the headlight lens parts 600A, 600B and 600C) of the motor vehicle headlight 60 by using the headlight lens part 600A' including a light source 18 for a drive light function, said light source 18 being designed as an LED and adapted to be connected, and including a light source 19 for a sign light function and being designed as an LED, wherein the light output of the light source 18 is higher than that of light source 19.

Figure 18:
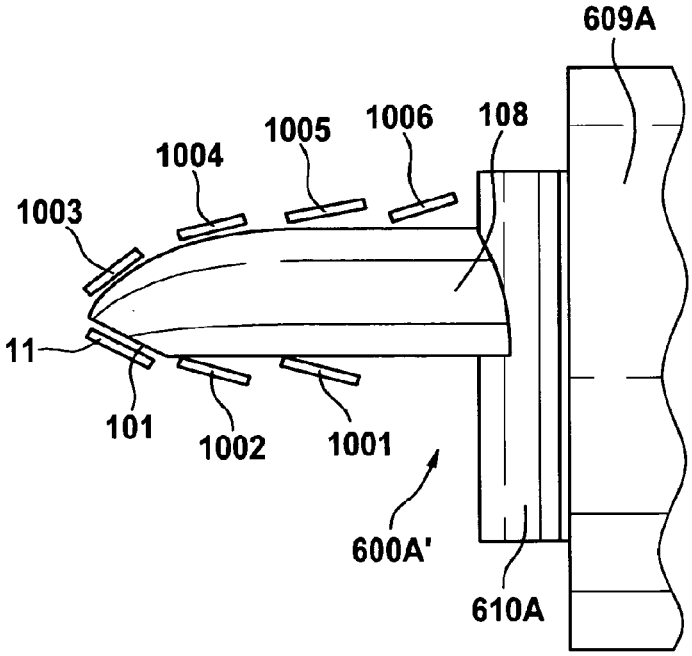
FIG. 18 shows a cut-out side-elevation of a further example of embodiment of a motor vehicle headlight for use in the motor vehicle according to FIG. 1.

FIG. 18 shows a further modification (concerning, only, the headlight lens part 600A or, only, the headlight lens parts 600A and 600B, or, only, the headlight lens parts 600A and 600C or the headlight lens parts 600A, 600B and 600C) of the motor vehicle headlight 60 by using the headlight lens part 600A' Herein, additional light sources 1001, 1002, 1003, 1004, 1005, 1006 are provided along the light tunnel 108. By means of this arrangement a higher light output may be achieved.

Figure 19:
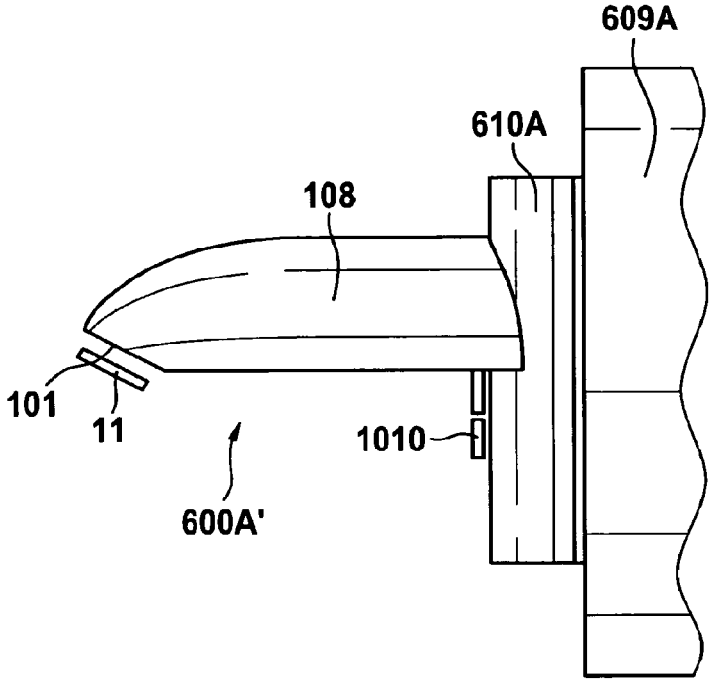
FIG. 19 shows a side elevation of a further example of embodiment of a motor vehicle headlight for use in the motor vehicle according to FIG. 1.

FIG. 19 shows a further modification (concerning, only, the headlight lens part 600A or, only, the headlight lens parts 600A and 600B, or, only, the headlight lens parts 600A and 600C or the headlight lens parts 600A, 600B and 600C) of the motor vehicle headlight 60 by using the headlight lens part 600A' Herein, by means of an LED array 1010 light is made to enter the Petzval-face-designed surface 610A of the light passage section 609A, the components of which array being adapted to be individually controlled and/or connected, respectively.

The headlight lens parts 600B and 600C may be modified corresponding to the specified modifications using the headlight lens part 600A' and/or using the headlight lens part 600A", respectively.

The elements, distances and angles in the figures have been drawn in consideration of simplicity and clearness and not necessarily to scale. For example, the orders of magnitude of some elements, distances and angles have been exaggerated with respect to other elements, distances and angles in order to improve comprehension of the example of embodiment of the present invention.

The invention claimed is:

1. Headlight lens for a vehicle headlight, the headlight lens comprising a monolithic body from transparent material, the monolithic body comprising:

a first light tunnel, which first light tunnel, via a first bend, passes over to a first light passage section; and at least a second light tunnel, which second light tunnel, via a second bend, passes over to a second light passage section, wherein a portion of the surface of the first light passage section is designed as a Petzval surface, wherein a portion of the surface of the second light passage section is designed as a Petzval surface, wherein the first light passage section comprises a first optically effective light exit surface for imaging the first bend as a bright-dark-boundary, and wherein the second light passage section comprises a second optically effective light exit surface for imaging the second bend as a bright-dark-boundary.

2. Headlight lens as claimed in claim 1, wherein the second optically effective light exit surface comprises an optical axis which is inclined, with respect to an optical axis of the first optically effective light exit surface by at least 4°.

3. Headlight lens as claimed in claim 1, the first light tunnel comprising a region on its surface which corresponds essentially to a part of the surface of an ellipsoid and the second light tunnel comprising a region on its surface which corresponds essentially to a part of the surface of an ellipsoid.

4. Headlight lens as claimed in claim 1, wherein a surface of the first light passage section facing the first light tunnel is curved convexly at least in the region of the first bend.

5. Headlight lens as claimed in claim 1, wherein the second optically effective light exit surface comprises an optical axis which is inclined, with respect to an optical axis of the first optically effective light exit surface.

6. Headlight lens as claimed in claim 1, wherein the second optically effective light exit surface comprises an optical axis which is inclined, with respect to an optical axis of the first optically effective light exit surface by at least 0.5°.

7. Headlight lens as claimed in claim 5, the first light tunnel comprising a region on its surface which corresponds essentially to a part of the surface of an ellipsoid and the second light tunnel comprising a region on its surface which corresponds essentially to a part of the surface of an ellipsoid.

8. Headlight lens as claimed in claim 5, the monolithic body further comprising:

at least a third light tunnel, which third light tunnel, via a third bend, passes over to a third light passage section, wherein the third light passage section comprises a third optically effective light exit surface for imaging the third bend as a bright-dark-boundary.

9. Headlight lens as claimed in claim 8, wherein the third optically effective light exit surface comprises an optical axis which is inclined with respect to the optical axis of the first optically effective light exit surface and with respect to the optical axis of the second optically effective light exit surface.

10. Headlight lens as claimed in claim 9, the first light tunnel comprising a region on its surface which corresponds essentially to a part of the surface of an ellipsoid, the second light tunnel comprising a region on its surface which corresponds essentially to a part of the surface of an ellipsoid, and the third light tunnel comprising a region on its surface which corresponds essentially to a part of the surface of an ellipsoid.

11. Headlight lens as claimed in claim 10, wherein a surface of the first light passage section facing the first light tunnel is curved convexly at least in the region of the first bend.

12. Headlight lens as claimed in claim 8, wherein the third optically effective light exit surface comprises an optical axis which is inclined with respect to the optical axis of the first optically effective light exit surface by at least 0.5° and with respect to the optical axis of the second optically effective light exit surface by at least 0.5°.

13. Headlight lens as claimed in claim 8, wherein the third optically effective light exit surface comprises an optical axis which is inclined with respect to the optical axis of the first optically effective light exit surface by at least 4° and with respect to the optical axis of the second optically effective light exit surface by at least 4°.

14. Headlight lens for a vehicle headlight, the headlight lens comprising a monolithic body from transparent material, the monolithic body comprising:

a first light tunnel, which first light tunnel, via a first bend, passes over to a first light passage section; and at least a second light tunnel, which second light tunnel, via a second bend, passes over to a second light passage section, wherein the first light passage section comprises a first optically effective light exit surface for imaging the first bend as a bright-dark-boundary, and wherein the second light passage section comprises a second optically effective light exit surface for imaging the second bend as a bright-dark-boundary, and the first bend being a curved transition having a radius of curvature of no less than 50 nm and of no more than 0.25 mm and the second bend being a curved transition having a radius of curvature of no less than 50 nm and of no more than 0.25 mm.

15. Headlight lens for a vehicle headlight, the headlight lens comprising a monolithic body from transparent material, the monolithic body comprising:

a first light tunnel, which first light tunnel, via a first bend, passes over to a first light passage section; and at least a second light tunnel, which second light tunnel, via a second bend, passes over to a second light passage section, wherein the first light passage section comprises a first optically effective light exit surface for imaging the first bend as a bright-dark-boundary, and wherein the second light passage section comprises a second optically effective light exit surface for imaging the second bend as a bright-dark-boundary, wherein the second optically effective light exit surface comprises an optical axis which is inclined, with respect to an optical axis of the first optically effective light exit surface, at least a third light tunnel, which third light tunnel, via a third bend, passes over to a third light passage section, wherein the third light passage section comprises a third optically effective light exit surface for imaging the third bend as a bright-dark-boundary, wherein the third optically effective light exit surface comprises an optical axis which is inclined with respect to the optical axis of the first optically effective light exit surface and with respect to the optical axis of the second optically effective light exit surface, and the first bend being a curved transition having a radius of curvature of no less than 50 nm and of no more than 0.25 mm, the second bend being a curved transition having a radius of curvature of no less than 50 nm and of no more than 0.25 mm and the third bend being a curved transition having a radius of curvature of no less than 50 nm and of no more than 0.25 mm.

16. Headlight lens for a vehicle headlight, the headlight lens comprising a monolithic body from transparent material, the monolithic body comprising:

a light passage section comprising:

a first optically effective light exit surface having an optical axis; and a second optically effective light exit surface having an optical axis which is inclined with respect to the optical axis of the first optically effective light exit surface by at least 0.5°;

a first light tunnel having a first light entry surface being inclined with respect to the optical axis of the first light exit surface at an angle of between 5° and 70°, which first light tunnel, via a first bend, passes over to the light passage section; and at least a second light tunnel having a second light entry surface being inclined with respect to the optical axis of the second light exit surface at an angle of between 5° and 70°, which second light tunnel, via a second bend, passes over to the light passage section, the first optically effective light exit surface being configured for imaging the first bend as a bright-dark-boundary, and the second optically effective light exit surface being configured for imaging the second bend as a bright-dark-boundary, the first bend being a curved transition having a radius of curvature of no less than 50 nm and of no more than 0.25 mm and the second bend being a curved transition having a radius of curvature of no less than 50 nm and of no more than 0.25 mm.

17. Headlight lens as claimed in claim 16, the first light tunnel comprising a region on its surface which corresponds essentially to a part of the surface of an ellipsoid and the second light tunnel comprising a region on its surface which corresponds essentially to a part of the surface of an ellipsoid.

18. Headlight lens as claimed in claim 16, wherein a surface of the light passage section facing the first light tunnel is curved convexly at least in the region of the first bend.

19. Motor vehicle headlight comprising:

a headlight lens for a vehicle headlight, the headlight lens comprising a monolithic body from inorganic glass, the monolithic body comprising:

a first light passage section comprising a first optically effective light exit surface and a second optically effective light exit surface;

a first light tunnel having a the first light entry surface, which first light tunnel, via a first bend, passes over to the first light passage section; and at least a second light tunnel having a the second light entry surface, which second light tunnel, via a second bend, passes over to a second light passage section;

the first optically effective light exit surface being configured for imaging the first bend as a bright-dark-boundary, and the second optically effective light exit surface being configured for imaging the second bend as a bright-dark-boundary; and a first light source for making light enter the first light entry surface; and a second light source for making light enter the second light entry surface, the first bend being a curved transition having a radius of curvature of no less than 50 nm and of no more than 0.25 mm and the second bend being a curved transition having a radius of curvature of no less than 50 nm and of no more than 0.25 mm.

20. Motor vehicle headlight as claimed in claim 19, the motor vehicle headlight further comprising:

a selectively switchable third light source arranged below the first light tunnel and configured for irradiating light into at least one of the group consisting of a bottom side of the first light tunnel and a surface of the first light passage section facing the first light tunnel.

* * * * *